United States Patent [19]

Parks

[11] Patent Number: 4,640,659

[45] Date of Patent: Feb. 3, 1987

[54] IMPELLER AND COMPACTION REFUSE COLLECTION SYSTEM

[76] Inventor: Hal Parks, 7323 W. Vogel Ave., Peoria, Ariz. 85345

[21] Appl. No.: 684,106

[22] Filed: Dec. 20, 1984

[51] Int. Cl.[4] ..... B65F 3/14

[52] U.S. Cl. ..... 414/503; 414/511; 414/523; 414/525 R; 414/526; 100/98 R

[58] Field of Search ..... 414/501, 502, 503, 511, 414/517, 523, 525 R; 414/526; 100/98 R

[56] References Cited

U.S. PATENT DOCUMENTS

| | | | |
|---|---|---|---|
| 2,505,731 | 4/1950 | Dear | 414/526 X |
| 3,613,926 | 10/1971 | Scroggins | 414/503 |
| 3,712,494 | 1/1973 | Lindeborg | 414/526 X |
| 3,944,098 | 3/1976 | Foote | 414/526 X |
| 4,069,929 | 1/1978 | Harker | 414/525 X |
| 4,078,677 | 3/1978 | Huggins, Jr. et al. | 414/525 X |
| 4,227,849 | 10/1980 | Worthington | 414/526 X |

FOREIGN PATENT DOCUMENTS

| | | | |
|---|---|---|---|
| 1200205 | 9/1965 | Fed. Rep. of Germany | 414/502 |
| 746053 | 2/1933 | France | 414/526 |
| 466794 | 1/1964 | Switzerland | 414/501 |

*Primary Examiner*—Robert J. Spar
*Assistant Examiner*—Ken Muncy
*Attorney, Agent, or Firm*—Thorpe, North & Western

[57] ABSTRACT

Apparatus and method for collection, compaction, and ejection of refuse wherein refuse initially dumped into a forward hopper compartment is conducted through an opening in a compaction plate into a storage compartment. A shredding device such as an auger-type impeller is formed as part of the compaction blade assembly and is moveable therewith between a forward position in the hopper compartment and a rearward, compaction position in the storage compartment. The combined impeller and compaction blade assembly permits initial shredding and compaction of refuse during transmission to the storage compartment, with periodic compaction of the storage compartment contents by displacement of the compaction blade assembly rearward. Ejection of refuse from the storage compartment is also accomplished by rearward displacement of the impeller and compaction blade assembly, thereby forcing the contained refuse through a rearward ejection door.

7 Claims, 3 Drawing Figures

IMPELLER AND COMPACTION REFUSE COLLECTION SYSTEM

BACKGROUND OF THE INVENTION

1. Field of the Invention

This invention pertains to compaction blades and/or ejection blades used in refuse collection vehicles or storage compartments. More particularly, the invention pertains to a combination of compaction blade and feeder system for transmitting refuse into a storage compartment.

2. Prior Art

Numerous structures have been developed to compress refuse in a storage compartment to a smaller volume, thereby increasing the capacity for storage within a given storage compartment. Typically, such structures are referred to as compaction blades. Such compaction blades commonly form one of the retaining walls of the storage compartment which can be movably displaced inward by hydraulic cylinders or other means to reduce the storage compartment volume.

An example of such a compaction blade is disclosed in U.S. Pat. Nos. 3,252,600; 4,067,464, and 4,067,466. As shown therein, such compaction blades can also be utilized to eject refuse through a rearward, ejection door of the storage compartment. Also, disclosed in these patents is a hopper compartment which is disposed forward of the storage compartment for the purpose of providing a container into which refuse may be dumped. Such refuse is advanced into the storage compartment by actuation of the compaction blade which pushed the refuse rearward through an opening which feeds into the storage compartment.

An opposing arrangement is disclosed in U.S. Pat. No. 3,994,098 (Foote) which shows a compaction blade at one side of a storage compartment, and the refuse feeder assembly at the opposite side of the storage compartment. The feeder assembly in this patent comprises an arrangement of impeller blades which capture refuse falling thereon and advance such refuse into the storage compartment. The benefit of such impeller blades arises from their tendency to shred refuse and provide some compaction before advancing the refuse into storage. In this configuration, however, the compaction blade compresses refuse against the opening through which the feeder assembly must advance incoming refuse. As new refuse is introduced, it must push aside the large volume of compacted refuse which has been pushed into a blocking position at the opening from the feeder assembly. Obviously, this imposes a substantial inertial force which must be overcome by the impeller assembly as it pushes refuse against the compressed refuse in the storage compartment. This severely limits the storage capacity of the unit. Other embodiments have used impeller blades, but have avoided combination with compaction blades because of the problem set forth above. Impeller blades similar to those used in U.S. Pat. No. 3,944,098, were disclosed in earlier patents including U.S. Pat. No. 2,505,731 (Dear), U.S. Pat. No. 3,712,494 (Lindeborg), and U.S. Pat. No. 2,776,770 (Laber). Each of these impellers are within an impeller housing having a cylindrical configuration of substantially uniform radius. A tapered impeller blade is disclosed in U.S. Pat. No. 4,227,849 (Worthington). The advantage of this tapered blade when used in a tapered housing, includes increased shredding action which facilitates compaction as the refuse is advanced in the narrower section of the channel housing.

None of the prior art known to the inventor has presented useful solutions to the problems associated with the arrangement illustrated in U.S. Pat. No. 3,944,098. These problems include the need to compact refuse which has been fed to a storage compartment by impeller blades. Even more important is the need for refuse compaction in a region of the storage compartment away from the impeller feeder assembly. Despite this long standing need, there appears to be strong favor in the industry toward positioning an impeller feeder assembly at an opposing location from the compaction blade so that compacted refuse is pushed toward the impeller feeder assembly. Alternatively, the unit does not even include compaction blades.

OBJECTS AND SUMMARY OF THE INVENTION

It is therefore an object of the present invention to provide a combination shedder and compaction blade assembly for improving storage capacity in refuse containers.

It is a further object of the present invention to provide a method of compaction and ejection of refuse which includes initial shredding and compacting of refuse to be stored in a storage compartment whose contents can be further compacted by a compaction blade.

It is a further object of the present invention to provide an integrated structure of shredder and compaction blade to reduce costs and improve efficiency of operation.

These objects are realized in a container for collection, compaction, and ejection of refuse which includes a refuse storage compartment and an ejection door mounted rearwardly on the storage compartment with means for releasing the door to void storage compartment contents. A compaction blade and impeller assembly is slidably positioned within the storage and hopper compartments and is coupled to hydraulic means which displace the blade and impeller assembly between a forward position in the hopper compartment and a rearward, compaction in the storage compartment. The impeller or other form of shedder is positioned within a channel housing attached to the compaction blade. This housing has a large, top opening originating in the hopper compartment and tapering to an opening in the compaction blade which communicates to the storage compartment. Refuse is thereby advanced from the hopper upon being caught in the blades of the impeller. As the refuse moves within the housing in response to the impeller blades's rotation, the refuse is shredded and otherwise processed for improved storage. When the channel housing is tapered as indicated, compaction of the shredded refuse results as it is urged along the housing and through the small opening leading into the storage compartment.

Other objects and features will be apparent from the following detailed description of a preferred embodiment of the subject invention. As part of this description, the following figures are included:

DETAILED DESCRIPTION OF THE INVENTION

Figure 1:
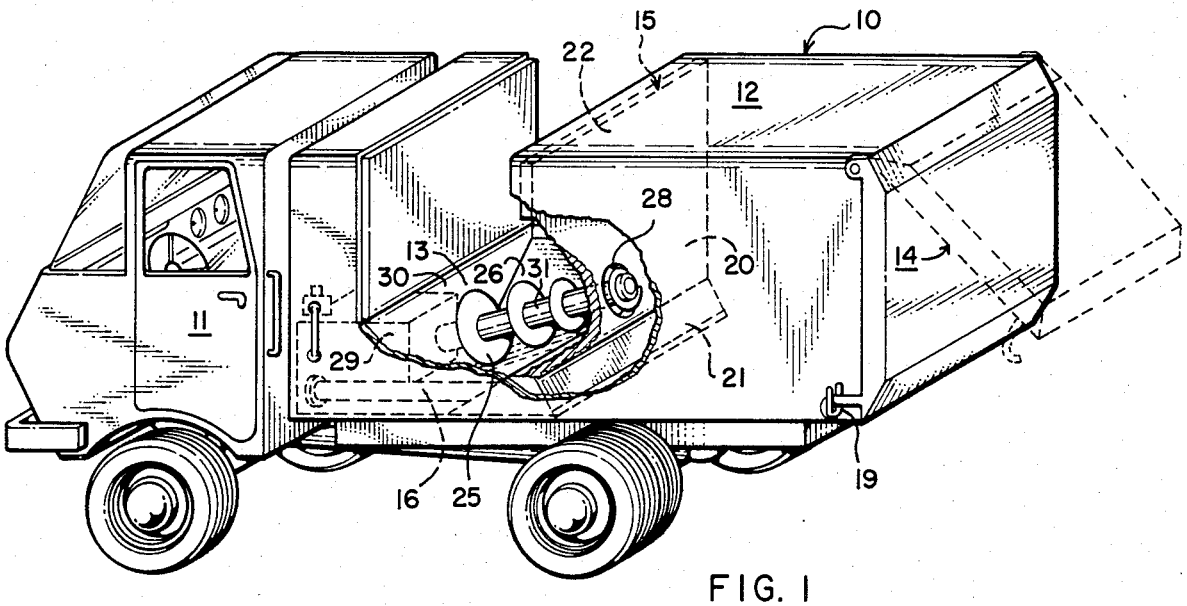
FIG. 1 is a top, perspective view of a trash collection vehicle in accordance with the design of the subject invention.
Figure 2:
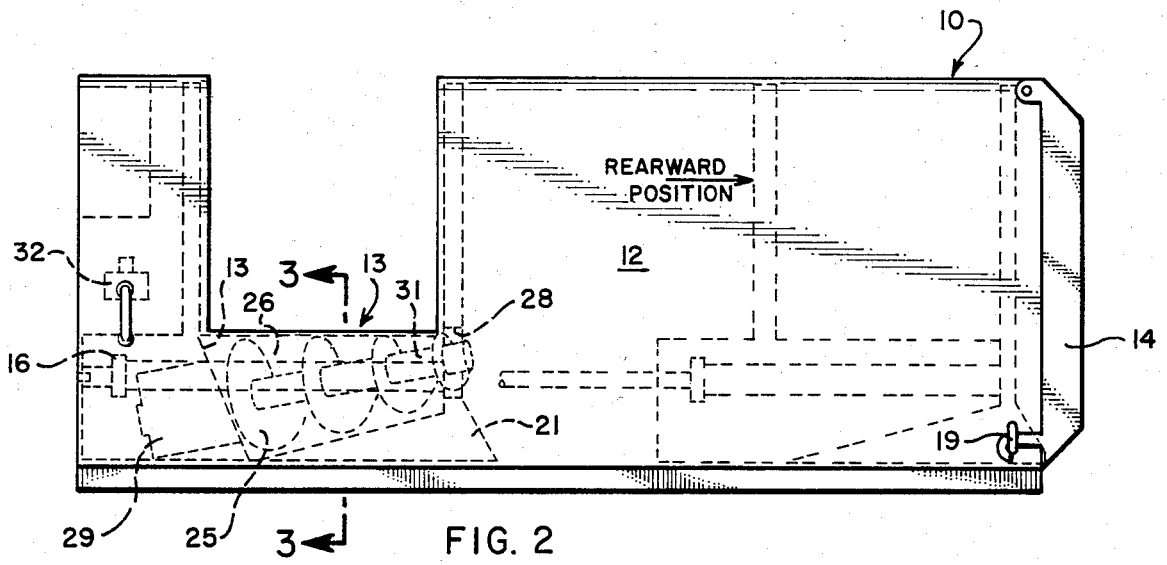
FIG. 2 is a side view of the subject invention without an attached vehicle.
Figure 3:
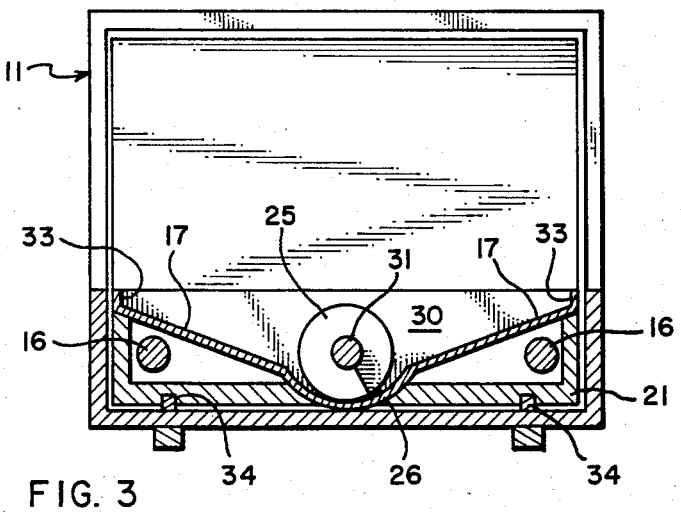
FIG. 3 is a cross-section of FIG. 2, taken along the lines 3—3 and detailing the impeller housing.

Referring now to the drawings:

FIG. 1 shows a trash collection and storage contained 10 mounted on a vehicle 11. The trash collection and storage container 10 is comprised of a storage compartment 12, a hopper compartment 13, and ejection door 14 with release assembly 19, a compaction blade and impeller assembly 15, and hydraulic cylinders 16 which displace the compaction blade and impeller assembly in forward and rearward motion. The storage compartment 12 includes forward and rearward ends and a confined volume therebetween which is enclosed between opposing sidewalls and the top and bottom walls. As used herein, reference to the term "forward" defines that part of the container or structure which is closest to the cab of vehicle 11 and opposite to the ejection door. The ejection door 14 is coupled to the top of the compartment 12 and encloses the rearward end thereof.

The primary inventive component is the compaction blade and impeller assembly 15. It includes a modified compaction blade 20 which extends upward from a base portion of the storage compartment 12 to form a moveable wall of fixed, vertical orientation which can be laterally displaced rearward to reduce the volume of the storage compartment and thereby crush or compact refuse contained therein. The compaction blade 20 is mounted on a subplatform 21 which is driven directly by the hydraulic cylinders 16. The method of attachment between the compaction blade and subplatform must be rigid to permit both elements to operate as a compression front capable of compacting refuse at the respective faces of the compaction blade and subplatform.

This compaction blade 20 provides a common upright wall between the storage compartment 12 containing refuse and the hopper 13 into which refuse in initially dropped. A secondary wall 22 may be formed to prevent refuse from falling in behind the compaction blade 20 as it is advanced rearward. The secondary wall would not be movable but would merely constitute an outer covering circumscribing the largest volume of storage compartment 12.

The subplatform 21 also operates as a base for supporting an impeller blade 25 and channel housing 26 for the impeller blade. Channel housing 26 is part of a floor wall 17 which is inclined to encourage gravity flow of refuse toward the channel housing 26. This housing represents a partial contour in the floor wall 17 which has a frustro-conical configuration which conforms to the volume used by the circulating blades of the impeller. The impeller is disposed within the contoured housing 26 to enhance channel movement of shredded refuse toward an opening 28 through a base portion of the compaction blade 20. The inner dimensions of the channel housing are slightly larger than the frustro-conical volume cut by the impeller blade as it rotates about its axis. The tapered construction of the housing an impeller blade provide compaction and shredding as refuse is caught at the rear or receiving portion of the blade and advanced into the housing and out the opening 28.

The impeller 25 has a tapered configuration and rests within the housing 26 with its small end positioned at or within the opening 28 through the base portion of the compaction wall 20. From this prospective, the small end of the impeller forms a dispensing end which operates to transfer shredded materials and refuse from the hopper compartment 13 into the storage compartment 12. Although an impeller structure 25 is illustrated in the drawings, it will be apparent to those skilled in the art that other forms of shredded devices can likewise be positioned within the hopper compartment. Typically, such shredding devices will have a receiving portion positioned within the hopper to receive refuse which is dumped therein. The shredding device also includes a dispensing end which is properly positioned at the opening 28 of the compaction blade 20. Obviously, this opening will have to be compatible in size with the specific shredding device selected.

In addition to the floor wall 17 of the hopper compartment, forward 30 and side 33 walls are provided to receive and retain the refuse for capture by the impeller. In the disclosed embodiment, the rearward wall of the hopper compartment comprises the compaction blade or the forward wall of the storage compartment.

Included in the compaction blade and impeller assembly is a high torque motor 20 which provides rotary power to the impeller. Ideally, this motor would be concealed under a cover 30 which guides refuse dumped into the hopper compartment toward the blades of the impeller. This motor forms an integral part with a shaft 31 which structurally supports the impeller blades.

As shown in the figures, therefore, the compaction blade and impeller assembly comprises the compaction blade 15, impeller 25 are attached motor 29, both being anchored to a subplatform 21 which provides a base for the assembly capable of forward and rearward movement. The method of operation of the compaction and impeller assembly is illustrated in a typical sequence as follows:

1. Refuse is dumped into the hopper compartment 13 where it naturally falls down the inclined walls 17, 30 of the hopper compartment into the rotating blades of the impeller 25.
2. The impeller blades capture such refuse and carry it rearward in the channel housing 26, shredding and crushing it as it approaches an opening 28 through the compaction blade 20.
3. This process of feeding refuse through the hopper into the storage compartment 12 is continued until refuse stored within the storage compartment tends to block opening 28 and thereby impede the flow of refuse. At this point, the compaction blade and impeller assembly is displaced rearward into the storage compartment 12 by means of hydraulic cylinders 16 which are actuated by a control lever 32. The subplatform 21 slides along track guides 34 at the bottom of the storage compartment pushing refuse rearward toward an ejection door 14. When maximum compaction is obtained, the compaction blade and impeller assembly are returned forward to the normal position for receiving refuse, with the impeller blade below the hopper.
4. Refuse may now be dumped into the hopper compartment and the process of feeding refuse through the impeller blade assembly may be continued. Refuse will now flow through opening 28 without obstruction from compressed refuse already contained within the storage compartment 12.
5. When the storage compartment is completely filled with compacted refuse, the storage compartment contents may be voided into a larger container or may be transported to a dump location for ejection. Ejection occurs by releasing a door opening means 19 at the ejection door 14 and then displacing the compaction blade and impeller assembly rearward to push the contained refuse through the ejection door. Such an operation can be actuated by a single ejection lever mode which provides automatic release and discharge of refuse as desired.

It should be noted that the subject invention can be applied with numerous types of storage compartments. These compartments may be either mobile or stationary, depending upon needs of customers. In each case, however, the type of storage compartments should have sufficient strength to withstand substantial pressure arising with the compaction of refuse therein.

Generally speaking, the subject invention provides for pre-processing or shredding of refuse material and then compacting the refuse in a storage compartment. A continuous moving auger-type shredder is rotated by a torque motor to accomplish the shredding action which somewhat reduces the volume of the refuse as it is conveyed through the taper of the impeller housing. In the compression phase of operation, when the compaction blade is advanced rearward, the operator may want to stop the torque motor for the impeller for safety reasons before he actuates the hydraulic cylinders which displace the compaction blade and impeller assembly rearward. The disclosed structure greatly increases the storage capacity of the storage compartment. Such increases have exceeded a factor of approximately 1.8 times the storage capacity for the same volume of compartment where a shredding device is used without compaction. Likewise, the subject invention increases storage by a factor of approximately 3 times over a unit having only a compaction blade and no shredding device. Accordingly, the combination provided by a shredding system which feeds the refuse through the compaction blade into the storage compartment provides surprisingly large increases in a conventional refuse tank.

Although preferred forms of the invention have been herein described, it is to be understood that the present disclosure is by way of example and that variations are possible without departing from the scope of the claimed subject matter, which subject matter is to be regarded as the invention.

I claim:

1. A transportable container for collection, compaction and ejection of refuse comprising:

a. a refuse storage compartment having forward and rearward ends and a confined volume between opposing side walls and top and bottom walls, said reward end of the compartment being closed by an ejection door coupled to the compartment and including means for releasing the ejection door in respense to ejection of refuse from the compartment;

b. the forward end of the compartment being enclosed by a movable compacting blade having a fixed, upright orientation and adapted with means for activating lateral reciprocating movement of the blade in its fixed, upright orientation between a forward, noncompacting position and a rearward compacting position which is disposed with the confined volume of the compartment, said compaction blade including an opening therethrough for communicating through the forward end;

c. a hopper compartment positioned immediately forward of the forward end and having forward, rearward, side and floor walls adapted for receiving refuse to be dumped therein;

d. a refuse shredding device attached at the floor of the hopper compartment, said device having a receiving portion and a dispensing end, said despensing end being positioned at the opening in the compaction blade when said blade is in the rearward position to dispose shredded refuse therethrough into the storage compartment for compaction the compaction blade is attached to the rearward part of the hopper compartment forming a single hopper/compaction blade structure, said shredding device being permanently disposed in a fixed position in relation to the compaction blade with its dispensing end at the opening therethrough, the combined blade and hopper being subject to movement by the reciprocating means between the rearward and forward positions.

2. A transportable container as defined in claim 1, wherein the compaction blade forms a common wall between the hopper compartment and the storage compartment.

3. A container as defined in claim 1, wherein the shredding device comprises a rotary impeller whose blades circulate through a frustro-conical volume and wherein the small end thereof forms the dispensing end which is positioned at the blade opening when the blade is at the rearward position.

4. A container as defined in claim 3, wherein the floor of the hopper compartment is partially contoured to form a channel housing conforming to one side of the frustro-conical configuration, said impeller being disposed within the housing to thereby channel movement of shredded refuse toward the blade opening, a top portion of the channel housing being open to allow the refuse dumped into the hopper to fall into the impeller.

5. A container as defined in claim 1, wherein the hopper and attached compaction blade provide the means for ejection or refuse through the ejection door in response to rearward movement of the combined hopper and blade structure.

6. A container as defined in claim 1, wherein the hopper and compaction blade are mounted to a common subplatform which is coupled to the reciprocating means to enable displacement of the combined hopper and blade structure as a single unit, said subplatform being adapted at its base for reciprocating movement along a track guide at the bottom wall of the storage compartment.

7. A container as defined in claim 1, wherein the dispensing end of the shredding device extends through the opening in the compaction blade into the storage compartment.

* * * * *